US009205682B2

(12) United States Patent
Shimura

(10) Patent No.: US 9,205,682 B2
(45) Date of Patent: Dec. 8, 2015

(54) PRINT CONTROLLING DEVICE, PRINT CONTROLLING METHOD, AND PROGRAM

(71) Applicant: CANON KABUSHIKI KAISHA, Tokyo (JP)

(72) Inventor: Norio Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/563,906

(22) Filed: Dec. 8, 2014

(65) Prior Publication Data

US 2015/0165793 A1 Jun. 18, 2015

(30) Foreign Application Priority Data

Dec. 12, 2013 (JP) ..... 2013-257156

(51) Int. Cl.
*B41J 11/66* (2006.01)

(52) U.S. Cl.
CPC ..... *B41J 11/663* (2013.01)

(58) Field of Classification Search
CPC ..... B41J 29/38; B41J 11/663
USPC ..... 347/16
See application file for complete search history.

(56) References Cited

U.S. PATENT DOCUMENTS 5,462,372 A * 10/1995 Hirono ..... 400/615.2
2011/0311293 A1* 12/2011 Yasuzaki ..... 400/583
2015/0010725 A1* 1/2015 Vogt et al. ..... 428/43

FOREIGN PATENT DOCUMENTS

JP 2004-182424 A 7/2004

* cited by examiner

*Primary Examiner* — Alessandro Amari
*Assistant Examiner* — Michael Konczal
(74) *Attorney, Agent, or Firm* — Canon U.S.A., Inc. IP Division

(57) ABSTRACT

A print controlling device includes a receiving unit that receives image data, a print controlling unit that causes a printing unit to print a cut mark and the received image data on a recording medium by using a recording agent, and a determining unit that determines whether the received image data includes a mark indicating a cut position of the recording medium. The print controlling unit causes the printing unit to print the cut mark when it is determined that the mark indicating the cut position is not included, and causes the printing unit not to print the cut mark when it is determined that the mark indicating the cut position is included.

13 Claims, 8 Drawing Sheets

FIG. 4

| | | |
|---|---|---|
| JobName | SamplePrint | |
| UserName | Operator1 | |
| OutputSize | 11x11 | |
| PrintMedia | glossy | |
| Pages | 2 | |
| Page:1 | ContentName | IMG_0001.pdf |
| | ContentType | PDF |
| | SheetCopies | 1 |
| | CorrectionMode | AUTO |
| | CropMark | ON |
| Page:2 | ContentName | IMG_0002.pdf |
| | ContentType | PDF |
| | SheetCopies | 10 |
| | CorrectionMode | AUTO |
| | CropMark | OFF |

PRINT CONTROLLING DEVICE, PRINT CONTROLLING METHOD, AND PROGRAM

BACKGROUND

1. Field

Aspects of the present invention generally relate to print controlling devices, print controlling methods, and programs that cause printing to be carried out using sheets.

2. Description of the Related Art

A method is known in which, while using a rolled continuous sheet (hereinafter, referred to as a roll sheet), a printed roll sheet is again taken up by a take-up device and is cut in a back-end process or cut with a cutting device provided in a printing apparatus.

With an apparatus disclosed in Japanese Patent Laid-Open No. 2004-182424, cut marks serving as guides for cutting a roll sheet are printed at actual cut positions for respective printed pages. Then, when printing is completed, the cut marks on the roll sheet are automatically detected so as to carry out a cutting operation.

Here, some applications or work flow systems that supply image data to be printed to a printing apparatus may add marks, such as a register mark and a crop mark, indicating cut positions to the image data to be transmitted to the printing apparatus. However, with the apparatus described in Japanese Patent Laid-Open No. 2004-182424, cut marks indicating cut positions are printed at actual cut positions for respective printed pages regardless of whether the image data includes a mark indicating a cut position, and thus a redundant cut mark may be printed. Therefore, a recording medium, such as paper, and a recording agent, such as ink, are wasted, and the printing throughput decreases.

SUMMARY

According to an aspect of the present invention, a print controlling device includes a receiving unit configured to receive image data, a print controlling unit configured to cause a printing unit to print a cut mark and the image data on a recording medium by using a recording agent, and a determining unit configured to determine whether the image data includes a mark indicating a cut position of the recording medium. The print controlling unit causes the printing unit to print the cut mark in a case where the determining unit determines that the mark indicating the cut position is not included, and causes the printing unit not to print the cut mark in a case where the determining unit determines that the mark indicating the cut position is included.

Further features of the present disclosure will become apparent from the following description of exemplary embodiments with reference to the attached drawings.

BRIEF DESCRIPTION OF THE DRAWINGS

FIG. 4 is a schematic diagram of a job ticket according to the first embodiment.

DESCRIPTION OF THE EMBODIMENTS

Hereinafter, exemplary embodiments will be described with reference to the drawings. It is to be noted that arrangement of the constituent elements relative to one another in apparatuses used in the embodiments, the shapes of the apparatuses, and so forth are merely illustrative and are not intended to be exclusive.

First Embodiment

Figure 1:
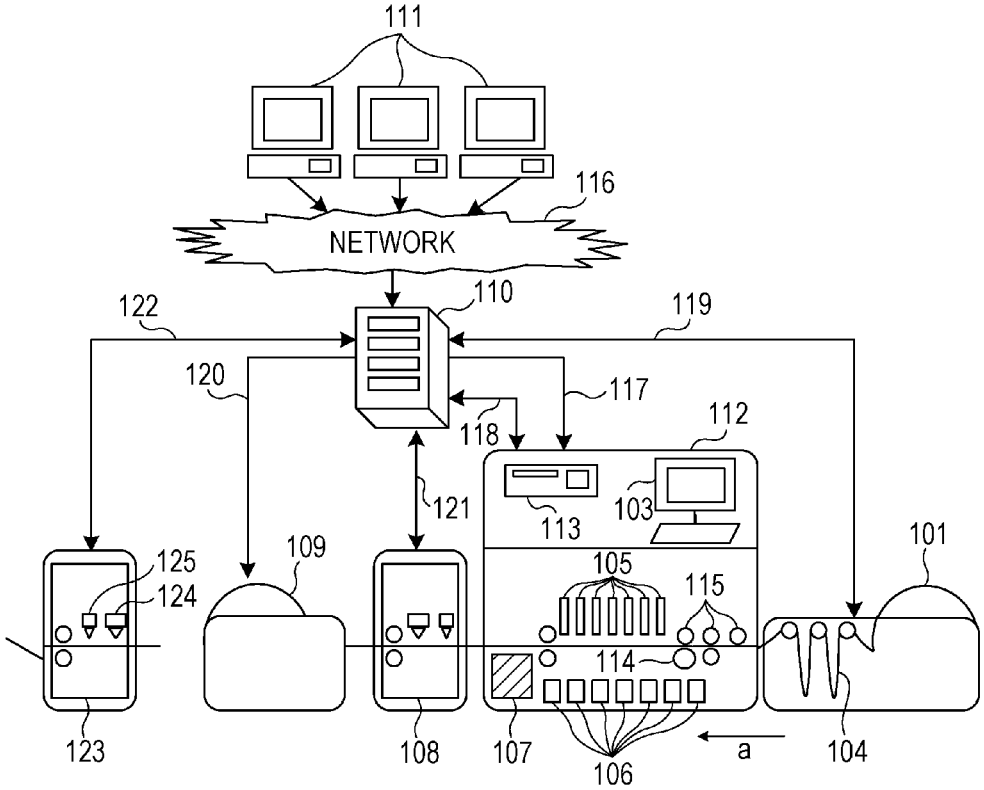
FIG. 1 is a schematic diagram illustrating an overall configuration of a printing system according to a first embodiment.

FIG. 1 illustrates a schematic configuration of a printing system according to an embodiment. Although the printing system illustrated in FIG. 1 is provided only with a printing function, the embodiment is not limited thereto. The embodiment may be applied to a system that further includes a reading apparatus for reading an image on a document and that functions as a copy machine or may also be applied to a multifunction system provided with other functions. In addition, although an example in which a roll sheet is used as a recording material (a recording medium or a recording sheet) on which print processing is carried out will be illustrated, a recording material is not limited to be in a rolled form as long as the recording material is a long continuous sheet on one side of which data corresponding to a plurality of pages can be printed without pausing the printing midway. The material for the recording material is not limited to paper, and various materials can be employed as long as print processing can be carried out on such materials. Furthermore, the printing method for printing images is not limited to an ink jet method in which a liquid ink for image printing is used, which will be described later. A solid ink may instead be used as a recording agent, or various printing methods, such as an electrophotographic method and a sublimation method that use toner, may be employed. The embodiment is not limited to color printing in which a plurality of colors of recording agents are used, and the embodiment may be applied to monochrome printing that uses only black (including gray).

FIG. 1 is a sectional view schematically illustrating an overall configuration of a printing system in which a roll sheet (a continuous sheet that is longer than a print unit (one page) in the conveying direction) is used as a recording material. The print system includes a paper feeding unit 101, an operation unit 103, a loop controlling unit 104, a recording head 105, an ink tank 106, a drying unit 107, a scanner unit 108, a take-up unit 109, a controller 110, a host computer 111, a printing apparatus 112, a controlling unit 113, an encoder 114, a rotary roller 115, a network 116, a data communication interface (IF) 117, command communication IFs 118 to 122, a cutting unit 123, a sensor 124, and a cutter 125, and these constituent elements are disposed in a plurality of housings. The paper feeding unit 101 feeds a roll sheet (hereinafter, referred to as a sheet). The take-up unit 109 takes up a sheet on which printing has been completed. The scanner unit 108 captures an image of a printed image so as to check the printed image. The controller 110 controls the printing apparatus 112 and carries out RIP processing. A print job is transmitted to the controller 110 through the network 116. The host computer 111 is provided to transmit a print job to the controller 110.

Hereinafter, each housing will be described in detail.

The host computer 111 transmits a print job to the controller 110 through the network 116. In the host computer 111, a print job is created by selecting an image to be printed and by setting the print size, the layout, and so forth. For an irregular-sized print job, such as a photo book, image data that includes a mark indicating a cut position in a back-end process is created, and the created image data serves as a print job. At this point, information indicating whether or not a mark indicating a cut position is included in a print job is added to the data for the print job, and the resulting print job is transmitted to the controller 110. Examples of a mark indicating a cut position include a crop mark, present in the image data, that indicates a cut position of a sheet. In addition, the host computer 111 obtains information on the progress of a transmitted print job from the controller 110 and the printing apparatus 112 for management. In the present embodiment, the host computer 111 on the network 116 is illustrated as an example of a unit for transmitting a print job, but the present embodiment is not limited thereto. Such a unit may be a host computer that is directly connected to the controller 110 or a portable medium, such as a Universal Serial Bus (USB) memory.

The controller 110 and the host computer 111 for transmitting job data to the controller 110 are connected to the network 116. The network 116 may be a wired or wireless network. The controller 110 carries out RIP processing of a print job transmitted from the host computer 111 and transmits image data that has been subjected to RIP processing to the printing apparatus 112 through the data communication IF 117. RIP processing is a process for converting a print job (print data) to a raster image format that can be handled by any given printing apparatus. The data communication IF 117 is constituted by an interface, such as an optical fiber, that is capable of high speed data transmission and reception in the present embodiment in order to transmit a large amount of image data.

The configurations of the host computer 111, the network 116, and the controller 110 are not limited to those described in the present embodiment. For example, although a single computer is used to receive a print job from the host computer 111 and to carry out RIP processing in the present embodiment, a separate computer may be provided to receive a print job, or a separate computer may be provided to carry out RIP processing. In addition, although RIP processing may be carried out in each printing apparatus, a case in which each printing apparatus receives print data that has been subjected to RIP processing will be described herein. Furthermore, as in a server configuration, processes, such as job reception and RIP processing, may be separately assigned to respective blades.

The controller 110 transmits a control command to the printing apparatus 112 through the command communication IF 118 so as to control the printing apparatus 112. In addition, the controller 110 transmits information on a print job and various pieces of setting data necessary for printing and controlling to the printing apparatus 112 through the command communication IF 118. Information on a print job includes information that indicates whether or not a mark indicating a cut position is included in image data to be printed. The controller 110 obtains, from the printing apparatus 112, information on the status of the printing apparatus 112 and information indicating whether a print job is in progress or has been completed. In addition, the controller 110 transmits control commands to the paper feeding unit 101, the take-up unit 109, and the scanner unit 108 through the command communication IFs 119, 120, and 121, respectively, so as to control these units.

The printing apparatus 112 receives image data that has been subjected to RIP processing from the controller 110 through the data communication IF 117. The printing apparatus 112 includes the recording head 105 serving as a printing unit, the ink tank 106 for supplying ink to the recording head 105, and the drying unit 107 for drying ink on a sheet. The operation unit 103 is a unit through which a user carries out various operations or which notifies the user of various pieces of information. The user can, for example, check the print status of each job, namely, whether a given job is in progress or has been completed, through the operation unit 103. In addition, through the operation unit 103, the user can check the conditions of the printing apparatus 112, such as a remaining ink amount and a remaining amount of the sheet, input a head position adjustment value and a registration adjustment value, instruct an apparatus maintenance operation, such as head cleaning, to be carried out. Furthermore, the printing apparatus 112 includes the controlling unit 113 that includes a controller (including a central processing unit (CPU) or a microprocessor unit (MPU)), a device for outputting user interface information (device for generating display information, sound information, etc.), and various I/O interfaces, and the controlling unit 113 controls the printing apparatus 112 as a whole. Furthermore, the printing apparatus 112 includes the encoder 114 that controls a conveyance amount and a conveyance condition. The configuration of the printing apparatus 112 is not limited to the one described in the present embodiment, and the printing apparatus 112 may include other units and sensors.

The paper feeding unit 101 feeds a sheet. As the user mounts a sheet on a control bar inside the paper feeding unit 101 and loads the sheet into the paper feeding unit 101, the sheet is set. The paper feeding unit 101 receives an instruction for starting to feed a sheet from the controller 110 through the command communication IF 119 and then starts to convey the sheet. In addition, the paper feeding unit 101 includes the loop controlling unit 104 that absorbs an error in the conveyance speed and can thus adjust the conveyance speed. A sheet pulled out from the paper feeding unit 101 is conveyed in a direction indicated by a in FIG. 1 and reaches the printing apparatus 112. Although the loop controlling unit 104 is provided in the paper feeding unit 101 in the present embodiment, a loop controlling unit for absorbing an error in the conveyance speed may be provided in the printing apparatus 112. In addition, although a roll sheet is illustrated as an example of a sheet to be supplied to the paper feeding unit 101 in the present embodiment, a continuous sheet that is not in a rolled form may instead be supplied.

The recording head 105 includes line heads of different colors arrayed in a direction along the conveying direction a of the time of printing. In the present embodiment, independent line heads corresponding to a plurality of colors (seven colors in the present embodiment) are held in the recording head 105 along the conveying direction of the sheet. In the present embodiment, the recording head 105 includes seven line heads corresponding to seven colors of C (cyan), M (magenta), Y (yellow), LC (light cyan), LM (light magenta), G (gray), and K (black). The recording head 105 may include a line head for an ink of another color, or not all of the inks of the aforementioned colors need to be used. The line heads of the aforementioned colors may be formed as a single continuous nozzle chip, or separate nozzle chips for the respective line heads may be arrayed regularly along a straight line or in a staggered array. In the present embodiment, a so-called full multi-head is used in which nozzles are arrayed so as to cover an entire width of a printable area of a sheet having a maximum size that can be used in the printing apparatus 112. An ink jet system for ejecting ink through nozzles can be selected from various methods, such as a method that uses a heating element, a method that uses a piezoelectric element, a method that uses an electrostatic element, and a method that uses a microelectromechanical system (MEMS) element. Ink is ejected through the nozzles in the line heads in accordance with print data, and the timing of the ejection is determined in accordance with an output signal of the encoder 114 for conveyance. The present embodiment is not limited to an ink jet printer that uses ink as a recording agent. The embodiment can be applied to various printing systems including an electrophotographic system, such as a thermal printer (sublimation type, thermal transfer type, etc.), a dot impact printer, a light emitting diode (LED) printer, and a laser printer.

The ink tank 106 stores inks of the respective colors separately. The inks are supplied to sub tanks provided so as to correspond to the respective colors through tubes, and the inks are then supplied from the sub tanks to the recording head 105 through tubes.

In the printing apparatus 112, ink is ejected from the recording head 105 in synchronization with the conveyance of a sheet, and thus an image is formed on the sheet. It is to be noted that the recording head 105 is disposed in such a manner that positions to which ink is ejected do not overlap the rotary roller 115. Although the recording head 105 is configured to eject ink directly onto a sheet in the present embodiment, ink may first be applied to an intermediate transfer body and the ink may then be applied to a sheet so as to form an image.

After an image is formed on a sheet, the sheet is conveyed to the drying unit 107. The drying unit 107 heats a sheet passing therethrough with a warm air (heated gas (air)) in order to dry ink that has been applied on the sheet in a short period of time. Instead of using a warm air, various methods can be employed to dry ink, and, for example, ink may be dried by using a cool air, by being heated with a heater, may be left to dry naturally, or may be dried by being irradiated with electromagnetic waves, such as ultraviolet light. After the image printed on the sheet has been dried, the sheet is conveyed to the scanner unit 108.

In the scanner unit 108, an image printed on a sheet is read so as to check the printed image. Specifically, a printed image or a particular pattern on a sheet is optically read so as to check whether there is a problem in the printed image or to check the conditions, such as the ejection state of ink, of the printing apparatus 112. A method for checking an image by using the scanner unit 108 is not particularly limited, and can be selected as appropriate from various methods. For example, the ejection state of ink may be checked by reading a pattern for checking the condition of the recording head 105, or the printing result may be checked by comparing a printed image with an original image. When it is determined that the state of the image or the condition of the printing apparatus 112 is not acceptable on the basis of the result obtained by the scanner unit 108 checking the image, the corresponding image can be hole-punched or marked, which makes it possible to identify which image has a problem. In addition, the controller 110 may be notified of the result of the check through the command communication IF 121. Although an image is read by the scanner unit 108 in the present embodiment, an image may be read by using an area sensor, such as a camera.

After the scanner unit 108 finishes checking the printed image, the sheet is conveyed to the take-up unit 109. The take-up unit 109 starts a take-up operation upon receiving a take-up instruction from the controller 110 through the command communication IF 120 so as to take up the sheet on which the image has been printed. Through this, the sheet on which the image has been printed by the printing apparatus 112 is put into a rolled sheet form.

The cutting unit 123 includes the sensor 124 for reading a cut mark and so forth and the cutter 125 serving as a cutting device for cutting a sheet, and cuts a printed sheet at a predetermined position. The cutting unit 123 exchanges control commands and various pieces of information with the controller 110 through the command communication IF 122. Furthermore, the cutting unit 123 includes the controlling unit that includes a controller (including a central processing unit (CPU) or a microprocessor unit (MPU)), and the controlling unit controls the cutting unit 123 as a whole.

It is to be noted that, at any given position on a sheet or on a sheet conveyance path, a side closer to the paper feeding unit 101 is referred to as "upstream," and a side opposite thereto is referred to as "downstream."

Figure 2:
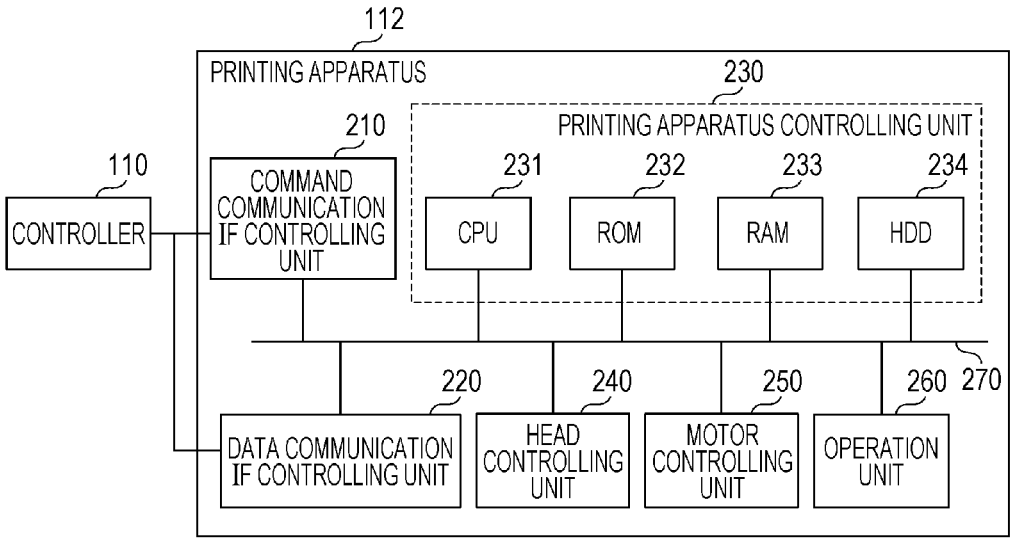
FIG. 2 is a block diagram of a printing apparatus according to the first embodiment.

FIG. 2 is a block diagram illustrating a control configuration of the printing apparatus 112. The printing apparatus 112 includes a command communication IF controlling unit 210, a data communication IF controlling unit 220, a printing apparatus controlling unit 230, a head controlling unit 240, a motor controlling unit 250, and an operation unit 260. These constituent elements are interconnected through a system bus 270.

The command communication IF controlling unit 210 and the data communication IF controlling unit 220 are IF controlling units for connecting the printing apparatus 112 and the controller 110. The command communication IF controlling unit 210 transmits and receives control commands and status information to and from the controller 110 through the command communication IF 118. The data communication IF controlling unit 220 receives print data from the controller 110 through the data communication IF 117.

The printing apparatus controlling unit 230 includes a CPU 231, a read only memory (ROM) 232, a random access memory (RAM) 233, and a hard disk drive (HDD) 234, and these constituent elements are interconnected through the system bus 270. The CPU 231 carries out various calculations and controls the printing apparatus 112 as a whole. The ROM 232 stores various control programs to be executed by the CPU 231 and fixed data necessary for the printing apparatus 112 to carry out various operations. The RAM 233 is used as a work area for the CPU 231 or as a temporary storage area of various pieces of received data or stores various pieces of setting data. The HDD 234 stores parameters, tables, and so forth necessary for the printing apparatus 112 to carry out various operations.

The printing apparatus controlling unit 230 controls the head controlling unit 240 and the motor controlling unit 250 in accordance with control commands received from the controller 110 through the command communication IF controlling unit 210 so as to print print data on a sheet.

The head controlling unit 240 controls driving of the recording head 105 in accordance with a control command received from the printing apparatus controlling unit 230 through the system bus 270 and print data received from the controller 110 through the data communication IF controlling unit 220 so as to print the print data on a sheet. In addition, the head controlling unit 240 prints a cut mark on a sheet in accordance with an instruction from the printing apparatus controlling unit 230.

The motor controlling unit 250 controls conveyance of a sheet by controlling driving of a paper feeding roller, driving of a conveying roller, and so forth, in accordance with control commands received from the printing apparatus controlling unit 230 through the system bus 270.

The operation unit 260 is a user IF and includes an input unit, such as a keyboard and a touch panel, and an output unit, such as a display and a sound generator for presenting information, in the present embodiment. The operation unit 260 sets parameters necessary for the printing apparatus 112 to carry out various operations and displays a print status, paper being used, and so forth.

Although the printing apparatus controlling unit 230 controls the head controlling unit 240 and the motor controlling unit 250 in accordance with control commands received from the controller 110 in the present embodiment, the embodiment is not limited thereto. Control commands may be transmitted and received among the aforementioned controlling units, or each of the controlling units may directly transmit and receive control commands to and from the controller 110.

In addition, although the paper feeding unit 101, the scanner unit 108, and the take-up unit 109 are connected to the controller 110 and transmit and receive control commands to and from the controller 110 in the present embodiment, the embodiment is not limited thereto. The paper feeding unit 101, the scanner unit 108, and the take-up unit 109 may be connected, for example, to the printing apparatus 112, and the printing apparatus controlling unit 230 may control the paper feeding unit 101, the scanner unit 108, and the take-up unit 109.

Furthermore, although the head controlling unit 240 directly receives print data from the controller 110 in the present embodiment, the embodiment is not limited thereto. The printing apparatus controlling unit 230 may receive print data from the controller 110 and transmit the print data to the head controlling unit 240 through the system bus 270. Now, image data printed by the printing apparatus 112 according to the present embodiment will be described with reference to FIGS. 3A and 3B. There are, for example, two types of image data to be printed by the printing apparatus 112, as illustrated in FIGS. 3A and 3B.

Figure 3A:
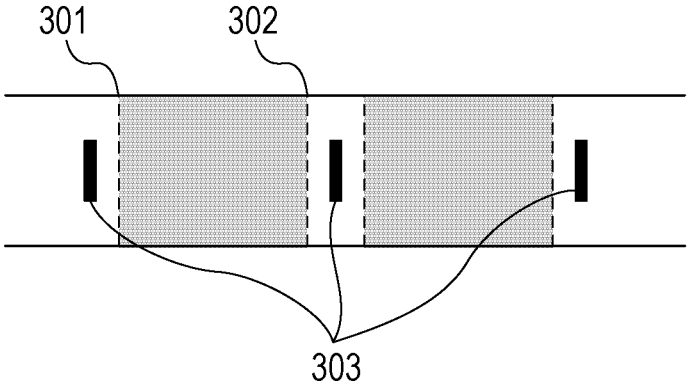
FIGS. 3A and 3B are schematic diagrams of image data according to the first embodiment.

The size of the image data illustrated in FIG. 3A in the widthwise direction matches the width of the sheet. When such image data is printed on a sheet, the sheet remains uncut in the widthwise direction in the back-end process and is used as-is as a final product. Such image data is used, for example, for simple leaf photographic printing. In FIG. 3A, an area enclosed by the dotted lines and the edges of the sheet indicates the image data, and according to the printing method illustrated in FIG. 3A, when successively printing image data on a sheet, the printing apparatus 112 prints a cut mark 303 serving as a cutting guide between adjacent pieces of image data. Then, in the back-end process, the sheet on which images have been printed successively is cut at an upstream side end 301 and a downstream side end 302 of the image data so as to obtain a final product.

Figure 3B:
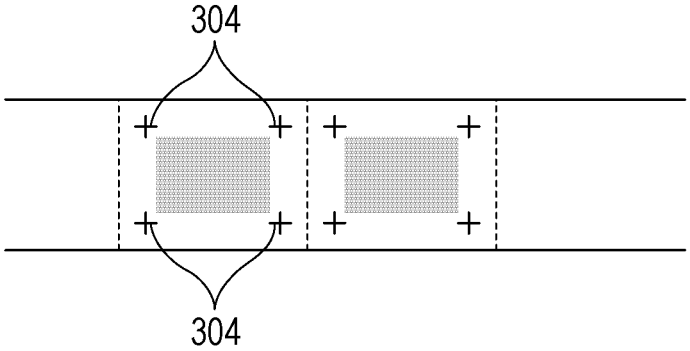

The image data illustrated in FIG. 3B includes a first data region corresponding to a final product and a second data region other than the first data region. When such image data is printed on a sheet, the second data region is cut off in the back-end process, and thus a final product constituted by the first data region is obtained. It is to be noted that a second data region corresponds to a region to be cut off in the back-end process. Such image data is used, for example, for printing an irregular format final product, such as a photo book. In FIG. 3B, an area between the dotted lines corresponds to image data, and the image data includes a first data region indicated by hatching and crop marks 304 indicating sheet cutting positions. Such crop marks 304 are added to image data in an upstream work flow process by, for example, the host computer 111 that generates the image data, and the image data that includes the crop marks 304 is transmitted to the printing apparatus 112. In the back-end process, a sheet on which images are printed successively is cut at four sides with the crop marks 304 serving as guides, and thus a final product constituted by a first data region can be obtained. In this case, the printing apparatus 112 does not need to print cut marks.

The printing apparatus 112 can also print image data in which the above-described two types of image data are mixed on a sheet.

The host computer 111 transmits a job ticket along with job data to the controller 110. The controller 110 then carries out RIP processing in accordance with the information in the job ticket and transmits image data to the printing apparatus 112. Here, FIG. 4 illustrates a job ticket indicating content of a print job created by the host computer 111. A job ticket includes, for example, the name of the job, the user name, an output size, an output medium, the number of pages, the name of content on each page, the type of the content, the number of copies to be outputted, the image correction modes, and information regarding the presence or absence of a mark indicating a cut position (crop mark in the example). Although information indicated in a job ticket is not limited to the examples listed above, a job ticket according to the present embodiment includes information indicating the presence or absence of a mark indicating a cut position. In the present embodiment, the controller 110 transmits, to the printing apparatus 112, image data and information indicating the presence or absence of a mark indicating a cut position for the image data on the basis of the information indicating the presence or absence of a mark indicating a cut position in the job ticket.

Figure 5:
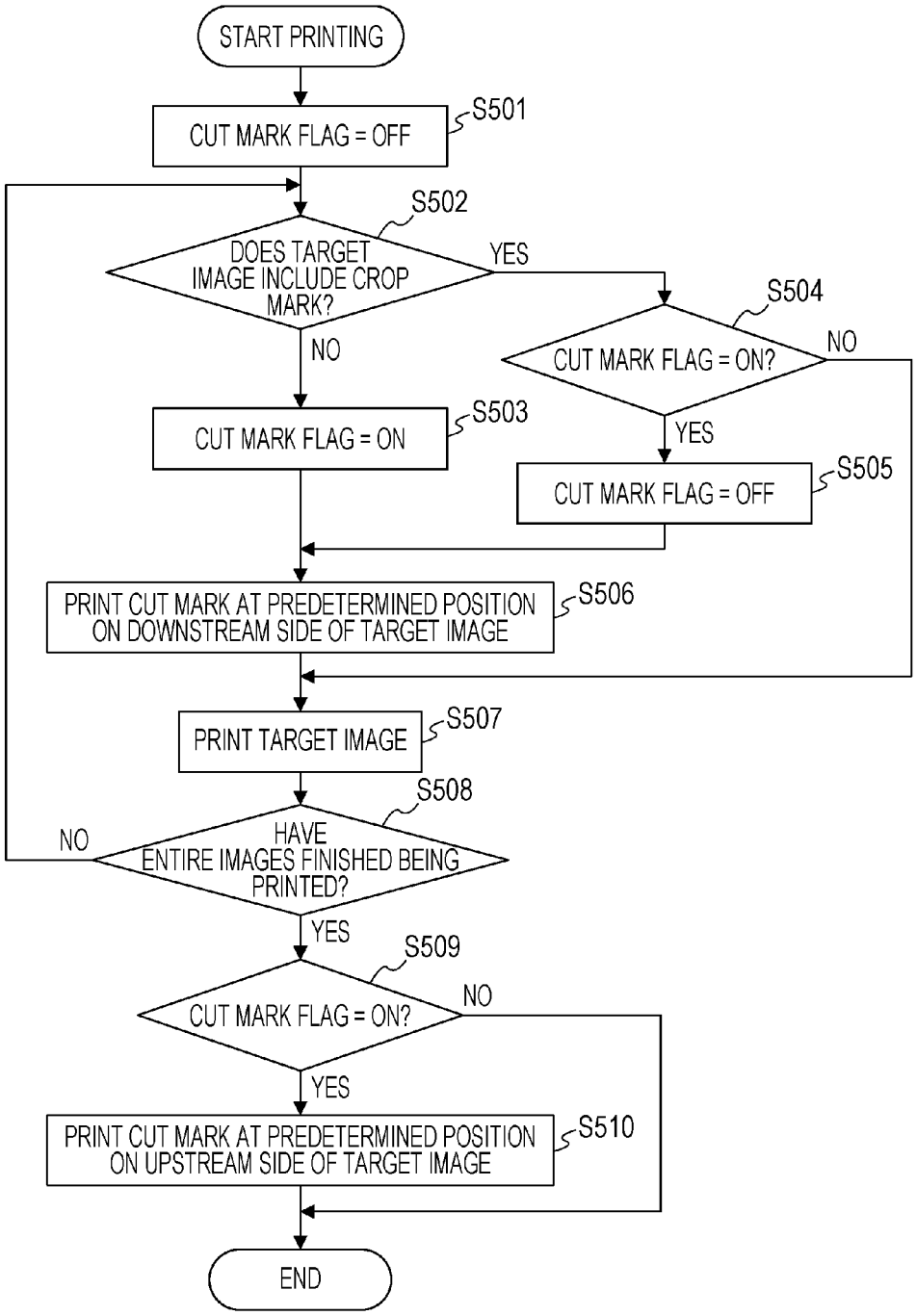
FIG. 5 is a flowchart illustrating a cut mark print control sequence according to the first embodiment.

With reference to FIG. 5, a print control sequence of a cut mark to be printed when an image is printed in the printing apparatus 112 according to the present embodiment will be described in detail. FIG. 5 is a flowchart illustrating a cut mark print control sequence executed by the CPU 231 of the printing apparatus controlling unit 230 of the printing apparatus 112.

Upon receiving a print start instruction from the controller 110, the CPU 231 sets a cut mark flag to OFF (S501).

The CPU 231 then determines whether or not a target image to be printed is image data that includes a mark indicating a cut position (S502). Specifically, the controller 110 obtains, from the host computer 111, a job ticket that includes information indicating whether or not a crop mark is included in a print job, namely, information indicating the presence or absence of a mark indicating a cut position along with data for the print job. The printing apparatus controlling unit 230 then obtains the information indicating the presence or absence of a mark indicating a cut position from the controller 110. The CPU 231 determines, on the basis of the information indicating the presence or absence of a mark indicating a cut position obtained from the controller 110, whether or not the target image includes a mark indicating a cut position. A crop mark is illustrated as an example of a mark indicating a cut position in the present embodiment.

If the CPU 231 determines in S502 that the target image does not include a crop mark, in S503, the CPU 231 sets the cut mark flag to ON. Thereafter, in S506, the CPU 231 controls the head controlling unit 240 so as to print a cut mark at a predetermined position on the downstream side of the target image, and then proceeds to S507.

If the CPU 231 determines in S502 that the target image includes a crop mark, in S504, the CPU 231 determines whether or not the cut mark flag is ON. If the CPU 231 determines that the cut mark flag is ON, in S505, the CPU 231 sets the cut mark flag to OFF. Then, in S506, the CPU 231 controls the head controlling unit 240 so as to print a cut mark at a predetermined position on the downstream side of the target image, and then proceeds to S507. Here, a case in which the target image includes a crop mark and the cut mark flag is ON correspond to a case in which the cut mark flag has been set to ON in the processing for an immediately preceding image. If the CPU 231 determines in S504 that the cut mark flag is OFF, the CPU 231 proceeds to S507. In S507, the CPU 231 controls the head controlling unit 240 so as to print the target image.

In S508, the CPU 231 determines whether or not the entire images have finished being printed. The CPU 231 determines that the entire images have finished being printed even in a case in which the trailing end of the sheet is detected and printing is thus ended in the present embodiment.

If the CPU 231 determines in S508 that the entire images have not yet finished being printed, the CPU returns to S502 and repeats the above-described control on a subsequent target image.

If the CPU 231 determines in S508 that the entire images have finished being printed, the CPU 231 proceeds to S509 and determines whether or not the cut mark flag is ON.

If the CPU 231 determines in S509 that the cut mark flag is ON, the CPU 231 proceeds to S510 and controls the head controlling unit 240 so as to print a cut mark at a predetermined position on the upstream side of the target image. Then, the operation sequence pertaining to the cut mark print control is terminated.

If the CPU 231 determines in S509 that the cut mark flag is OFF, the operation sequence pertaining to the cut mark print control is terminated.

Figure 6:
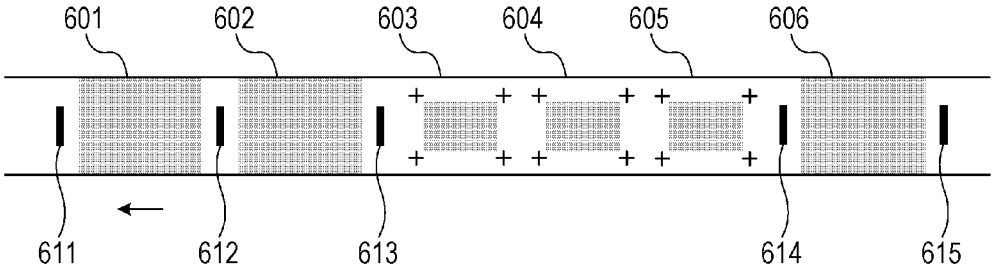
FIG. 6 is an image diagram illustrating a result of printing obtained through the print control sequence according to the first embodiment.

FIG. 6 is an illustration indicating a print result on a sheet that has been printed through the print control sequence according to the present embodiment. Printing of the sheet will be described in association with the flowchart of the print control sequence illustrated in FIG. 5. The sheet is conveyed in a direction indicated by an arrow in FIG. 6, and an image 601, an image 602, an image 603, an image 604, an image 605, and an image 606 are printed sequentially.

Upon receiving a print start instruction, the CPU 231 first sets the cut mark flag to OFF (S501).

The CPU 231 then determines whether or not an image 601 serving as a target image is image data that includes a crop mark (S502). The image 601 does not include a crop mark, and thus the CPU 231 sets the cut mark flag to ON (S503). The CPU 231 then prints a cut mark 611 at a predetermined position on the downstream side of the image 601 serving as the target image (S506) and prints the image 601 (S507). In other words, the CPU 231 prints the image 601 after printing the cut mark 611. That is to say, the cut mark 611 is printed immediately before the image 601 is printed.

Subsequently, since the entire images have not yet finished being printed (S508), the CPU 231 returns to S502 and determines whether or not the image 602 includes a crop mark in a similar manner. The image 602 does not include a crop mark, either, and thus the CPU 231 sets the cut mark flag to ON (S503). The CPU 231 then prints a cut mark 612 at a predetermined position on the downstream side of the image 602 (S506) and prints the image 602 (S507). In other words, the CPU 231 prints the image 602 after printing the cut mark 612. That is to say, the cut mark 612 is printed immediately before the image 602 is printed.

Thereafter, since the entire images have not yet finished being printed (S508), the CPU 231 returns to S502 and determines whether or not the image 603 includes a crop mark. The image 603 includes a crop mark, and thus the CPU 231 determines whether or not the cut mark flag is ON (S504). Here, since the CPU 231 has set the cut mark flag to ON in the processing flow for the image 602, the CPU 231 sets the cut mark flag to OFF (S505). The CPU 231 then prints a cut mark 613 at a predetermined position on the downstream side of the image 603 (S506) and prints the image 603 (S507). In other words, the CPU 231 prints the image 603 after printing the cut mark 613. That is to say, the cut mark 613 is printed immediately before the image 603 is printed.

Subsequently, since the entire images have not yet finished being printed (S508), the CPU 231 returns to S502 and determines whether or not the image 604 includes a crop mark. The image 604 also includes a crop mark, and thus the CPU 231 determines whether or not the cut mark flag is ON (S504). Here, since the CPU 231 has set the cut mark flag to OFF in the processing flow for the image 603, the CPU 231 prints the image 604 without printing a cut mark (S507).

In a similar manner, since the entire images have not yet finished being printed (S508), the CPU 231 returns to S502 and determines whether or not the image 605 includes a crop mark. The image 605 also includes a crop mark, and thus the CPU 231 determines whether or not the cut mark flag is ON (S504). Here, since the cut mark flag remains being OFF, the CPU 231 prints the image 605 without printing a cut mark (S507).

Thereafter, since the entire images have not yet finished being printed (S508), the CPU 231 returns to S502 and determines whether or not the image 606 includes a crop mark. The image 606 does not include a crop mark, and thus the CPU 231 sets the cut mark flag to ON (S503). The CPU 231 then prints a cut mark 614 at a predetermined position on the downstream side of the image 606 (S506) and prints the image 606 (S507). In other words, the CPU 231 prints the image 606 after printing the cut mark 614. That is to say, the cut mark 614 is printed immediately before the image 606 is printed.

Since the entire images have finished being printed upon the image 606 being printed (S508), the CPU 231 determines whether or not the cut mark flag is ON (S509). Here, since the CPU 231 has set the cut mark flag to ON in the processing flow for the image 606, the CPU 231 prints a cut mark 615 at a predetermined position on the upstream side of the image 606 serving as the target image (S510) and terminates the processing.

In the present embodiment, in a case in which a crop mark indicating a cut position is present in image data, a cut mark to be inserted by the printing apparatus 112 is not printed. Through this, ink to be used to print a cut mark can be saved, and a roll sheet to be consumed by printing a cut mark can be saved. Thus, the printing throughput can be improved.

Thereafter, the roll sheet on which the images have been printed by the printing apparatus 112 is once taken up by the take-up unit 109 disposed downstream from the printing apparatus 112 and results in a rolled sheet form. The roll sheet that has been taken up is then cut by the cutting unit 123.

Now, with reference to FIG. 7, a sequence of cutting a roll sheet, on which images have been printed, in the cutting unit 123 will be described.

Figure 7:
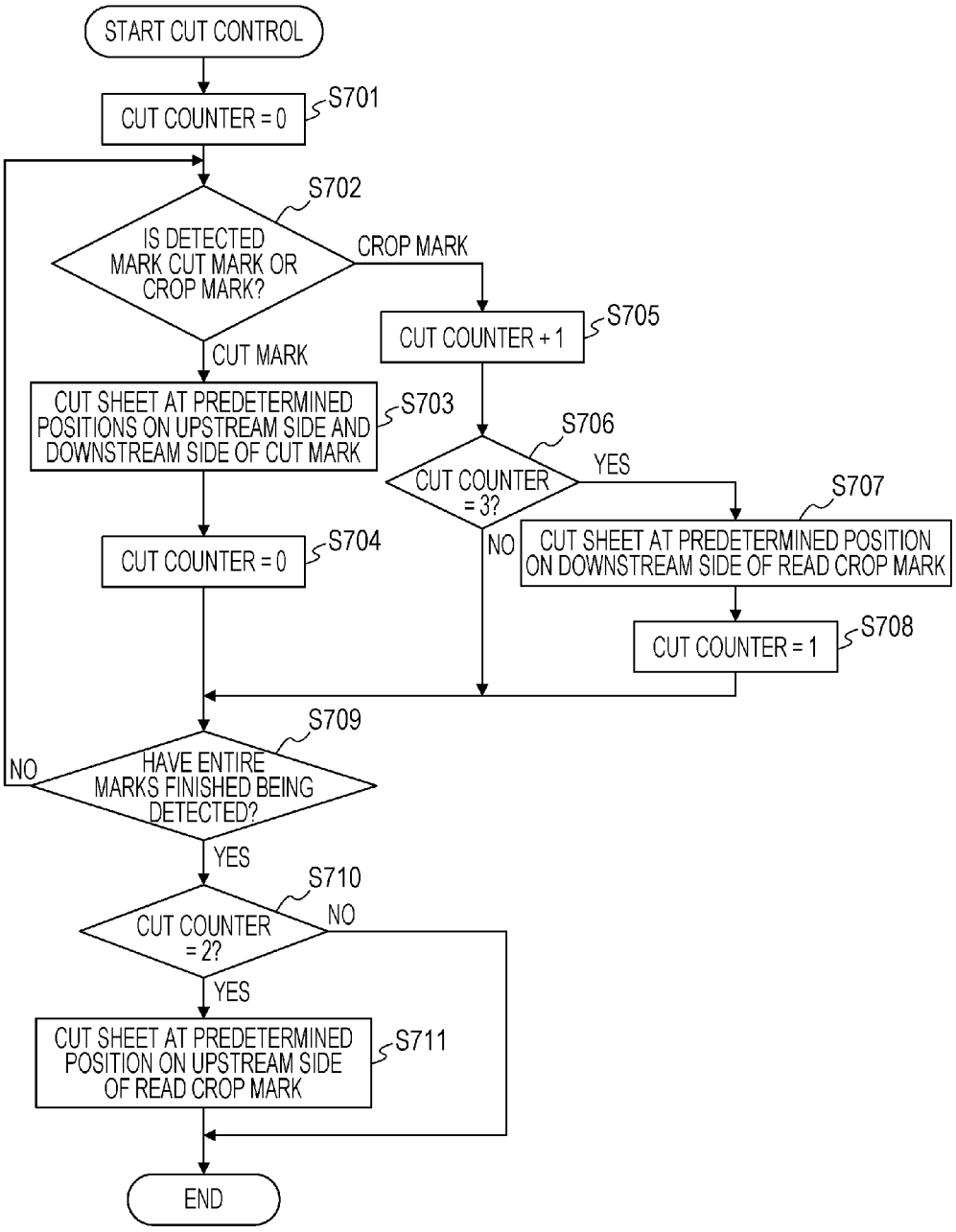
FIG. 7 is a flowchart illustrating a cut control sequence according to the first embodiment.

FIG. 7 is a flowchart illustrating a cut control sequence executed by a CPU (not illustrated) included in the cutting unit 123.

The CPU clears a cut counter to 0 on the basis of a cut start instruction from the controller 110 (S701).

The CPU then determines whether a mark read by the sensor 124 is a cut mark or a crop mark.

In S702, if the CPU determines that the read mark is a cut mark, the CPU proceeds to S703 and controls the cutter 125 so as to cut the sheet at predetermined positions on the upstream side and on the downstream side of the cut mark. Thereafter, in S704, the CPU clears the cut counter to 0 and proceeds to S709.

In S702, if the CPU determines that the read mark is a crop mark, the CPU proceeds to S705 and increments the cut counter. Then, in S706, the CPU determines whether or not the cut counter is 3. If the CPU determines in S706 that the cut counter is 3, the CPU proceeds to S707 and controls the cutter 125 so as to cut the sheet at a predetermined position on the downstream side of the position of the crop mark read in S702. In the case of FIG. 6, for example, the cut counter becomes 3 when the crop mark provided on the downstream side of the data corresponding to a final product for the image 603, the crop mark provided on the upstream side of the data corresponding to a final product for the image 603, and the crop mark provided on the downstream side of the data corresponding to a final product for the image 604 are counted. Thereafter, in S708, the CPU sets the cut counter to 1 and proceeds to S709. In S706, if the CPU determines that the cut counter is not 3, the CPU leaves the sheet uncut and proceeds to S709.

In S709, the CPU determines whether or not the entire marks have finished being detected.

In S709, if the CPU determines that the entire marks have not yet finished being detected, the CPU returns to S702 and repeats similar control on another detected mark.

In S709, if the CPU determines that the entire marks have finished being detected, in S710, the CPU determines whether or not the cut counter is 2.

In S710, if the CPU determines that the cut counter is 2, the CPU controls the cutter 125 so as to cut the sheet at a predetermined position on the upstream side of the position of the crop mark read in S702 (S711). When the entire marks have finished being detected, for example, the cut counter becomes 2 as a crop mark provided on the downstream side of the data corresponding to a final product for a target image and a crop mark provided on the upstream side of the data corresponding to a final product for the target image are counted, and thus the sheet is cut at the upstream side of the target image. Thereafter, the cut sequence of the cutting unit 123 is terminated.

If the CPU determines in S710 that the cut counter is not 2, the cut sequence of the cutting unit 123 is terminated.

Through the control illustrated in FIG. 7, in a case in which a printed sheet includes both a cut mark and a crop mark, the sheet can be controlled to be cut at each desired position.

Second Embodiment

In the first embodiment, the cutting unit 123 carries out the cutting processing on a printed sheet that has been taken up by the take-up unit 109 in the back-end process. In the meantime, in the present embodiment, the cutting unit 123 is disposed in place of the take-up unit 109 illustrated in FIG. 1, and the cutting unit 123 cuts the sheet without taking up the printed sheet. It is to be noted that descriptions of configurations that are similar to those of the first embodiment will be omitted.

Figure 8:
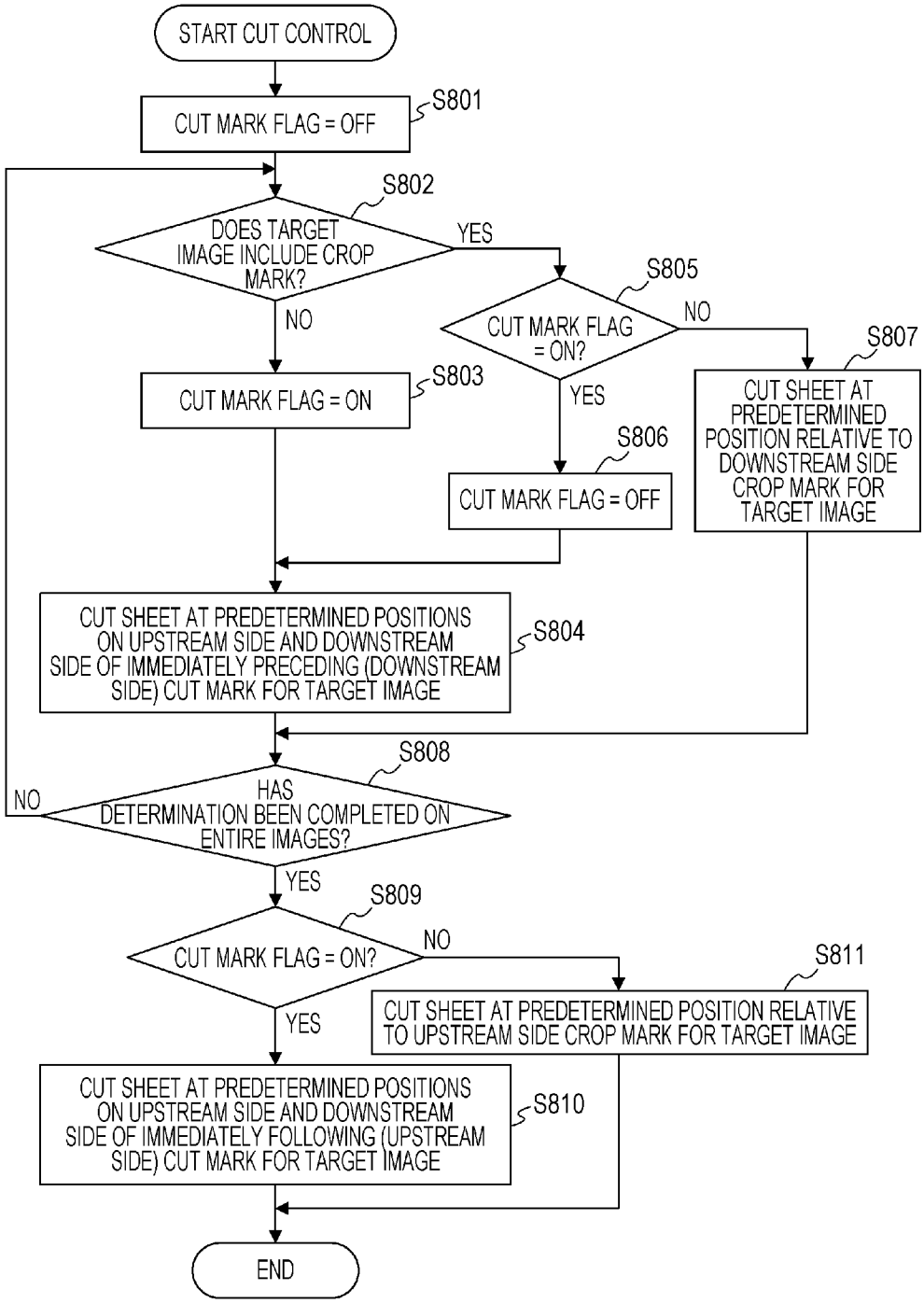
FIG. 8 is a flowchart illustrating a cut control sequence according to a second embodiment.

FIG. 8 is a flowchart illustrating a cut control sequence controlled by the cutting unit 123 according to the present embodiment.

Upon receiving a cut start instruction from the controller 110, the cutting unit 123 sets a cut mark flag to OFF (S801).

The cutting unit 123 then determines whether or not a target image to be cut out is image data that includes a crop mark (S802). Specifically, the controller 110 obtains, from the host computer 111, a job ticket that includes information indicating whether or not a crop mark is included in a print job, namely, information indicating the presence or absence of a crop mark along with data for the print job. The cutting unit 123 then obtains the information indicating the presence or absence of a crop mark from the controller 110. The cutting unit 123 determines, on the basis of the information indicating the presence or absence of a crop mark obtained from the controller 110, whether or not the target image includes a crop mark.

In S802, if the cutting unit 123 determines that the target image does not include a crop mark, the cutting unit 123 proceeds to S803 and sets the cut mark flag to ON, and the cutting unit 123 then proceeds to S804.

In S802, if the cutting unit 123 determines that the target image includes a crop mark, in S805, the cutting unit 123 determines whether or not the cut mark flag is ON. If the cutting unit 123 determines that the cut mark flag is ON, in S806, the cutting unit 123 sets the cut mark flag to OFF and proceeds to S804.

In S804, the cutting unit 123 controls the cutter 125 so as to cut the sheet at predetermined positions on the upstream side and on the downstream side of the cut mark, read by the sensor 124, that is immediately preceding (or on the downstream side of) the target image. Thereafter, the cutting unit 123 proceeds to S808.

In S805, if the cutting unit 123 determines that the cut mark flag is OFF, in S807, the cutting unit 123 controls the cutter 125 so as to cut the sheet at a predetermined position on the downstream side of the downstream side crop mark of the crop marks, read by the sensor 124, for the target image. Thereafter, the cutting unit 123 proceeds to S808.

In S808, the cutting unit 123 determines whether or not the determination processing of the entire images has been completed.

In S808, if the cutting unit 123 determines that the determination processing of the entire images has not been completed, the cutting unit 123 returns to S802 and repeats similar control on a subsequent target image.

In S808, if the cutting unit 123 determines that the determination processing of the entire images has been completed, in S809, the cutting unit 123 determines whether or not the cut mark flag is ON.

If the cutting unit 123 determines in S809 that the cut mark flag is ON, the cutting unit 123 proceeds to S810 and controls the cutter 125 so as to cut the sheet at predetermined positions on the upstream side and on the downstream side of the cut mark, read by the sensor 124, that is immediately following (or on the upstream side of) the target image. Thereafter, the cut sequence of the cutting unit 123 is terminated.

If the cutting unit 123 determines in S809 that the cut mark flag is OFF, in S811, the cutting unit 123 controls the cutter 125 so as to cut the sheet at a predetermined position on the upstream side of the upstream side crop mark of the crop marks, read by the sensor 124, for the target image. Thereafter, the cut sequence of the cutting unit 123 is terminated.

Through the control illustrated in FIG. 8, in a case in which a printed sheet includes both a cut mark and a crop mark, the sheet can be controlled to be cut at each desired position.

Although the cutter 125 is controlled so as to cut the sheet at a predetermined position relative to a crop mark in S807 and S811 in the present embodiment, the embodiment is not limited thereto. For example, the cutting unit 123 may obtain, from the controller 110, information on a cut position relative to a crop mark along with information as to whether or not the target image includes a crop mark, and may cut the sheet at a predetermined position. In this case, the host computer 111 may identify positional information of each crop mark relative to an edge of a corresponding image when generating image data that includes a crop mark as a print job and may add the positional information to the data for the print job. Then, the host computer 111 may transmit the print job to the controller 110.

Other Embodiments

The above-described exemplary embodiments are not seen to be limiting. For example, although the printing apparatus 112 carries out control by determining whether or not to print a cut mark on the basis of information as to whether or not the target image includes a crop mark in the embodiments described above, another apparatus may make such a determination and carry out such control. Specifically, instead of the printing apparatus 112, the host computer 111 or the controller 110 may make a determination and, on the basis of the result of the determination, may transmit an instruction indicating whether or not to print a cut mark to the printing apparatus 112.

In addition, although the printing apparatus 112 determines the presence or absence of a crop mark for each image and carries out control as to whether or not to print a cut mark in the embodiments described above, the user may be allowed to set the print settings for cut marks to ON or OFF. Specifically, the printing apparatus 112 may be provided with a function for setting whether or not to print a cut mark, and as the user sets the print setting for the cut mark to ON or OFF, the cut mark may be controlled to be or not to be printed regardless of the state of the image data.

Although the host computer 111 adds information indicating the presence or absence of a crop mark in a target image to job data for a print job and transmits the print job to the controller 110, and the controller 110 then transmits the print job to the printing apparatus 112 in the embodiments described above, the embodiment is not limited thereto. For example, instead of the host computer 111 transmitting the information indicating the presence or absence of a crop mark, the controller 110 or the printing apparatus 112 may scan image data and determine whether or not the image data includes a crop mark.

In addition, although the information indicating the presence or absence of a crop mark is included in a job ticket in the embodiments described above, the embodiment is not limited thereto. For example, patterns of crop marks may be stored, and if a mark having a similar pattern is detected at a predetermined position, it may be determined that a crop mark is present.

Although a crop mark is illustrated as an example of a mark indicating a cut position in the embodiments described above, the shape of a mark indicating a cut position is not limited to a particular shape, and any mark that makes it possible to identify a cut position can be employed.

In addition, although an example in which images are printed on a continuous sheet is illustrated in the embodiments described above, additional embodiments can also be applied to a case in which an image is printed on a recording medium such as a cut sheet. In other words, it may be determined whether image data includes a cut mark that indicates a cut position of a cut sheet, and, on the basis of the result of the determination, it may be determined whether to print a cut mark.

The embodiments described above may also be realized by carrying out the following processing. Specifically, software (program) that realizes the functions of the embodiments described above is supplied to a system or to an apparatus through a network or in the form of various storage media, and a computer (a CPU, an MPU, or the like) in the system or in the apparatus then loads and executes the program. In addition, the program may be executed by a single computer or may be executed by a plurality of computers that cooperate. In addition, instead of realizing the entire processing described above by software, part or all of the processing may be realized by hardware, such as an application specific integrated circuit (ASIC). In addition, the embodiment is not limited to a case in which the entire processing is carried out by a single CPU, and a plurality of CPUs may cooperate as appropriate to carry out the processing.

According to the embodiments described above, an amount of a recording medium or a recording agent being wasted can be reduced, and the printing throughput can be improved. More specifically, by refraining from printing a cut mark in a case in which a mark indicating a cut position is present in image data, the print amount of cut marks can be reduced, and the printing throughput can be improved.

Other Embodiments

Additional embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like. While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-257156, filed Dec. 12, 2013, which is hereby incorporated by reference herein in its entirety.

What is claimed is:

1. A print controlling device, comprising:

a receiving unit configured to receive image data;

a print controlling unit configured to cause a printing unit to print a cut mark not included in the received image data and the received image data on a recording medium; and a determining unit configured to determine whether the received image data includes a mark indicating a cut position of the recording medium, wherein the print controlling unit causes the printing unit to print the cut mark not included in the received image data in a case where the determining unit determines that the received image data does not include the mark indicating the cut position, and causes the printing unit not to print the cut mark not included in the received image data in a case where the determining unit determines that the received image data includes the mark indicating the cut position.

2. The print controlling device according to claim 1, wherein the receiving unit receives information indicating presence or absence of the mark indicating the cut position in the image data along with the image data, and wherein the determining unit makes a determination based on the information indicating the presence or absence of the mark indicating the cut position received by the receiving unit.

3. The print controlling device according to claim 1, further comprising:

a cut controlling unit configured to cause a cutting unit to cut the recording medium; and an identifying unit configured to identify the mark indicating the cut position of the recording medium, wherein the cut controlling unit causes the cutting unit to cut the recording medium in a case where the identifying unit identifies the mark indicating the cut position.

4. The print controlling device according to claim 1, wherein the mark indicating the cut position includes a crop mark.

5. The print controlling device according to claim 1, wherein the print controlling device includes the printing unit.

6. The print controller device according to claim 1, wherein the cut mark not included in the received image data is inserted in accordance with an instruction from the print controlling device.

7. The print controlling device according to claim 1, wherein the cut mark not included in the received image data is inserted between adjacent pieces of image data.

8. A print controlling method, comprising:

receiving image data;

controlling a printing unit to print a cut mark not included in the received image data and the received image data on a recording medium; and determining whether the received image data includes a mark indicating a cut position of the recording medium, wherein, the printing unit prints the cut mark not included in the received image data in a case where it is determined that the received image data does not include the mark indicating the cut position, and the printing unit does not print the cut mark not included in the received image data in a case where it is determined that the received image data includes the mark indicating the cut position.

9. The print controlling method according to claim 8, wherein, information indicating presence or absence of the mark indicating the cut position in the image data is received along with the image data, and wherein, a determination is made based on the information indicating the presence or absence of the mark indicating the cut position.

10. The print controlling method according to claim 8, further comprising:

cutting the recording medium; and identifying the mark indicating the cut position of the recording medium, wherein, the recording medium is cut in a case where the mark indicating the cut position is identified.

11. The print controlling method according to claim 8, wherein the cut mark not included in the received image data is inserted in accordance with an instruction from the print controlling device.

12. The print controlling method according to claim 8, wherein the cut mark not included in the received image data is inserted between adjacent pieces of image data.

13. A non-transitory computer readable storage medium storing computer executable instructions that cause a computer to implement a print controlling method, the print controlling method comprising:

receiving image data;

controlling a printing unit to print a cut mark not included in the received image data and the received image data on a recording medium; and determining whether the received image data includes a mark indicating a cut position of the recording medium, wherein, the printing unit prints the cut mark not included in the received image data in a case where it is determined that the received image data does not include the mark indicating the cut position, and the printing unit does not print the cut mark not included in the received image data in a case where it is determined that the received image data includes the mark indicating the cut position.

* * * * *